United States Patent [19]

Mayer

[11] Patent Number: 4,559,509

[45] Date of Patent: Dec. 17, 1985

[54] ELECTROPHOTOGRAPHIC COPYING APPARATUS INCLUDING ELECTRICALLY BIASED TRANSFER STATION AND METHOD

[75] Inventor: Edward F. Mayer, San Jose, Calif.

[73] Assignee: Ricoh Company Ltd., Tokyo, Japan

[21] Appl. No.: 529,082

[22] Filed: Sep. 2, 1983

[51] Int. Cl.[4] ..... G03G 15/16

[52] U.S. Cl. ..... 355/3 TR; 355/14 TR

[58] Field of Search ..... 355/3 TR, 14 TR, 3 CH; 430/33, 126; 101/DIG. 13

[56] References Cited

U.S. PATENT DOCUMENTS

| | | | |
|---|---|---|---|
| 2,951,443 | 9/1960 | Byrne | 430/126 |
| 3,363,555 | 1/1968 | Olden | 101/426 |
| 4,341,456 | 7/1982 | Iyer et al. | 355/3 TR |
| 4,384,784 | 5/1983 | Mayer | 355/14 R |
| 4,396,273 | 8/1983 | Matsuyama et al. | 355/3 TR |

*Primary Examiner*—A. T. Grimley
*Assistant Examiner*—J. Pendegrass
*Attorney, Agent, or Firm*—Flehr, Hohbach, Test, Albritton & Herbert

[57] ABSTRACT

There is disclosed herein an electrophotographic copying apparatus and its method of operation in which electrically charged toner of one polarity is transferred from an oppositely charged electrostatic image on the outer surface of its photoconductive drum to the front side of a blank sheet for transforming the latter into an intended copy as the back side of the blank sheet engages the outer surface of a transfer roll positioned adjacent the drum. In accordance with one feature of this apparatus, both the front side of the blank sheet, before it receives toner, and the outer surface of the transfer roll are biased such that each carries the same charge as the drum surface and such that the combined voltage level of both is greater than the voltage level of the electrostatic image. In accordance with another feature, the biasing means is designed for changing this combined voltage level in a way which improves the transferring capability of the apparatus, especially when more than one copy is made from a single electrostatic image.

7 Claims, 1 Drawing Figure

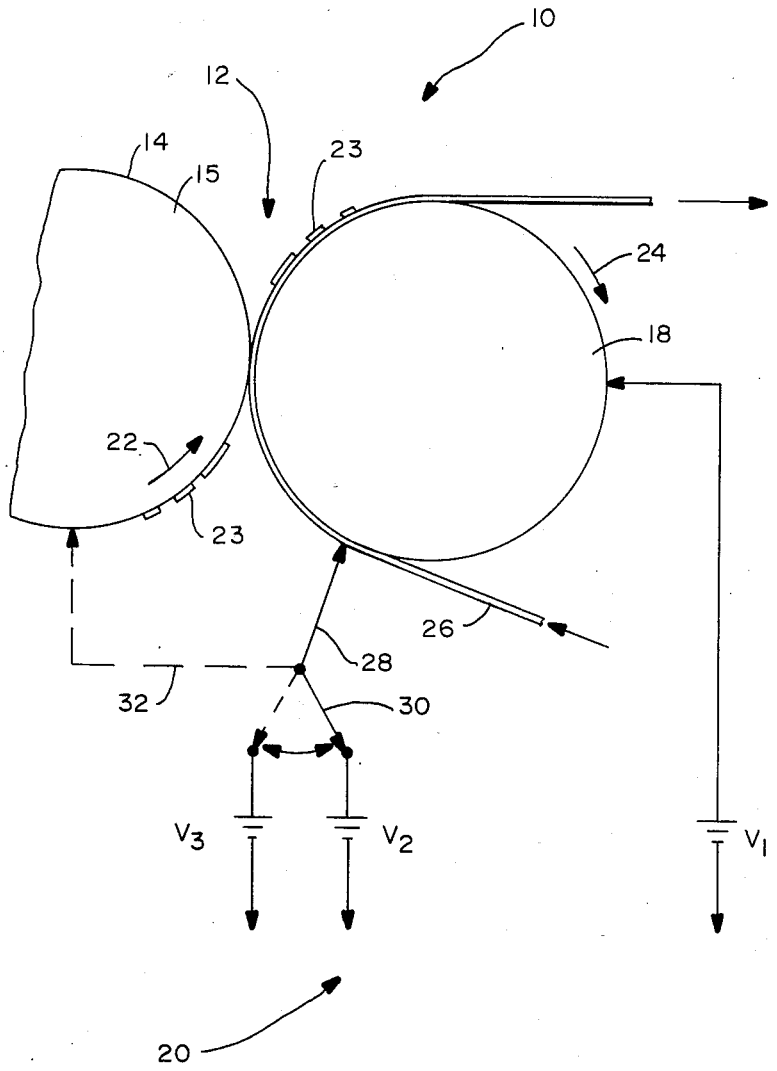
10
12
14
15
23
24
18
22
23
26
28
32
30
$V_3$
$V_2$
$V_1$
20

ELECTROPHOTOGRAPHIC COPYING APPARATUS INCLUDING ELECTRICALLY BIASED TRANSFER STATION AND METHOD

The present invention relates generally to an electrophotographic copying apparatus and its method of operation in which electrically charged toner of one polarity is transferred from an oppositely charged electrostatic image on the outer surface of its photoconductive drum to the front side of a blank sheet for transforming the latter into an intended copy as the back side of the sheet engages the outer surface of a transfer roll positioned adjacent the drum. This apparatus relates particularly to a specific means of electrically biasing the blank sheet and/or transfer roll in order to improve the toner transferring step in the overall coping process.

The present invention is especially suitable for use in an electrophotographic apparatus of the typical type which is presently being used in the industry. This typical apparatus includes a rotatable drum having a photosensitive outer circumferential surface and means for rotating the drum in a controlled fashion so that its outer circumferential surface defines a fixed annular path of movement. The apparatus produces copies from a given master by first forming an electrostatic latent image corresponding to the particular information to be copied on the photosensitive outer circumferential surface of the drum. Thereafter, the latent image formed is developed by means of the toner particles, specifically electrically charged, heat fusible particles, which are applied to the image bearing surface in a specific way. Finally, the applied toner particles are transferred from the drum to a blank sheet and thereafter fused thereon for transforming the sheet into a permanent copy.

In the apparatus just described, the toner transfer step is carried out with the aid of a transfer roll in cooperation with the blank sheet and the photoconductive drum. More specifically, the transfer roll is designed to receive the back side of the blank sheet in a way which places the front side of the latter in engaging, confronting relationship with the toner carrying outer surface of the photoconductive drum. This causes the toner on the drum to engage the blank paper. At the same time, toner particles are electrically charged (typically negative) and the electrostatic image on the photoconductive drum is biased with a voltage of the opposite polarity (typically positive). In order to cause the toner particles to move from the drum to the paper, the latter is charged to the same polarity as that of the drum but at a higher voltage level. This can be done by means of an electrically charged brush as in U.S. Pat. No. 4,341,456 or by depositing positive charges directly on the front face of the paper as in U.S. Pat. No. 4,384,784. In either case, the voltage level which is attainable on the sheet alone is limited and might not be sufficient to adequately transfer toner from the drum to the sheet.

In U.S. Pat. No. 4,384,784 recited immediately above, the specific electrophotographic copying apparatus described is one having a photoconductive drum which is specifically designed to retain an electrostatic latent image on its outer surface for two cycles of the drum, whereby to be able to provide two copies from a single image. In other words, if more than one copy is to be made from a given original, each time an electrostatic image corresponding to that original is placed on the photoconductive drum, two copies are made from that single image. This means that the single latent image is developed a first time with toner and the latter is transferred to a blank sheet in order to form a first copy and the same image is then developed a second time with toner and this latter toner is then transferred to the sheet to form a second copy. While this is satisfactory generally, it has been found to be difficult to maintain the same degree of development for both the first copy and the second copy. The development conditions differ in that the electrical potentials defining the latent image tend to decay with time and in that untransferred toner after the first transfer step tends to remain on the drum surface. Taking both of these factors into consideration, there is a tendency for more toner to be transferred during formation of the second copy than formation of the first one from a given image. In other words, the second copy tends to be darker than the first copy.

In view of the foregoing, it is one object of the present invention to provide an electrophotographic coping apparatus in which electrically charged toner of one polarity is transferred in an uncomplicated and reliable way from an oppositely charged electrostatic image on the outer surface of its photoconductive drum to the front side of a blank sheet for transforming the latter into an intended copy as the back side of the sheet engages the outer surface of a transfer roll positioned adjacent the drum. It is a specific object of the present invention to provide an uncomplicated and yet reliable technique for electrically biasing the blank sheet just mentioned to a voltage level which is higher than but the same polarity as the drum. This is accomplished in accordance with the present invention by not only charging the blank sheet itself, but at the same time, biasing the transfer roll itself. In a preferred embodiment, the blank sheet and the transfer roll are each biased to the same level as the electrostatic image on the drum, thereby resulting in twice the voltage level at the transfer point as compared to the voltage level of the image.

Another object of the present invention is to provide an electrophotographic copying apparatus of the type which is capable of making two copies from a single electrostatic latent image and specifically to a technique for making both copies of equivalent quality. This technique takes into account that the electrical potentials forming the latent image decay with time and that there will be untransferred toner remaining on the photoconductive drum after formation of the first copy. Specifically, means are provided for establishing a voltage bias at the paper, as the latter receives toner from the drum in order to affect the transfer of toner, in the same manner discussed above. In other words, a voltage level at the paper is of the same polarity as the electrostatic image but maintained at a higher voltage level. In addition, the biasing means automatically provides a voltage level at the paper of a first magnitude as the first copy is processed from a given image and of a second, lesser magnitude as the second copy is processed sufficient to ensure that the same amount of toner is transferred during the processing of each copy so that the two are uniform in quality.

The overall apparatus including the various features just recited will be described in more detail hereinafter in conjunction with the drawing wherein sole FIG. 1 diagrammatically illustrates part of an overall electrophotographic copying apparatus including specific toner transfer station designed in accordance with several aspects of the present invention.

Turning now to FIG. 1, as stated above, this figure illustrates part of an electrophotographic copying apparatus which is generally indicated by the reference numeral 10 and a toner transfer station generally indicated at 12 forming part of the apparatus. The overall apparatus is also shown including a rotatable photoconductive drum 14 which is rotated by means not shown in a controlled manner so as to cause its outer photoconductive surface 16 to move along a fixed annular path through a charging station, an exposure station, a developing station and thereafter a transfer station 12. None of these stations are illustrated, except for transfer station 12 which is shown including a rotatable transfer roll 18 and a voltage biasing arrangement 20.

In actual operation, photoconductive drum 14 is caused to rotate in the direction of arrow 22 for causing a segment of the drums outer surface to move through the charging station in order to cause a segment of surface 15 to charge to the desired voltage level and polarity, for example +500 volts. Thereafter, the charged surface segment is moved through the exposure station where a like image of an original or master is projected onto the moving drum in order to discharge portions of its charged surface and thus form an electrostatic image conforming to the original, as represented by various voltage levels up to a maximum of the original +500 volts provided. The electrostatic image thus formed, generally indicated at 23, is then moved through the developing station which contains a suitable arrangement including a supply of heat fusible toner charged to a polarity opposite that of the latent image, for example a negative polarity, and means for applying the toner to the drums outer surface. Thus, as the image bearing drum surface moves through the developing station, the charged toner is applied thereto causing it to develop the image. Immediately after the latent image on the drum has been developed it is moved through transfer station 12 which includes the previously mentioned transfer roll 18 and biasing arrangement 20. The transfer station also includes means not shown either supporting the transfer roll for free rotation or rotating it in a positive manner in the direction of arrow 24 and means, again not shown, for carrying a supply of blank paper 26 (either in separate sheets or continuous in form) through a fixed path around and against the transfer roll into engagement with the outer surface of the photoconductive drum such that the toner on the latter is transferred to the blank sheet in the manner to be described below, thereby forming a copy of the original, as indicated by the transferred toner generally represented by the reference numeral 23. Immediately after toner is transferred to paper 26, the latter is caused to move through the fusing station which, as stated above, serves to fuse the toner onto the paper, thereby providing a permanent copy. A cutting mechanism (not shown) is provided downstream from the fusing station in order to cut the copy to the appropriate size, assuming the paper in provided in a continuous, uncut sheet. More often, individual pre-cut sheets are used, in which case a cutting mechanism is not required.

Turning specifically to the way in which toner is transferred from photoconductive drum 14 to blank paper 26 it should first be noted that the toner takes the form of particles electrically charged to a polarity opposite that of the electrostatic image. For purposes of description, it will be assumed that the electrostatic latent image is positively charged to a maximum of +500 volts and that the toner particles are negatively charged (although the polarities could be reversed). Biasing arrangement 20 which will be described hereinafter places a positive voltage on the paper as the latter engages the photoconductive drum and the positive voltage so provided is of a level substantially greater than the maximum voltage level forming the electrostatic image. In this way, there is a sufficient positive voltage level differential between the paper and the photoconductive drum to cause the toner particles to be drawn off of the drum and onto the paper.

In accordance with one feature of the present invention, overall biasing arrangement 20 includes a first source of positive voltage, specifically voltage source $V_1$ for biasing the transfer roll itself to a positive voltage level of $V_1$. At the same time, the front face of continuous sheet 26 is also positively biased. In the embodiment illustrated, this is accomplished by either one of two voltage sources $V_2$ and $V_3$ through an electrode brush generally indicated at 28.

It is important to note that the biasing arrangement thus far described provides for simultaneously biasing the transfer roll and the front face of continuous sheet 26. This is to be contrasted with the prior art discussed previously in which only the paper itself was biased. In a preferred embodiment of the present invention, the transfer roll is biased to a level equivalent to the maximum voltage level forming the electrostatic image, for example +500 volts. At the same time, the face of continuous sheet 26 is preferably biased to the same level, thereby resulting in a total biasing level of about +1000 volts, which is more than sufficient to ensure the satisfactory transfer of toner from the drum to the continuous sheet. In this particular embodiment, the face of continuous sheet 26 can be biased in the manner shown or it can be positively charged by means of a charging device, as described in previously recited patent application Ser. No. 199,096. Also, a single voltage source with suitable voltage dividing circuitry could be utilized to bias both the transfer roll and the continuous sheet.

Overall biasing arrangement 20 is shown not only including the three voltage sources $V_1$, $V_2$ and $V_3$ and charging brush 28 but also a switch 30 which is designed to alternatively connect brush 28 to the two voltage sources $V_2$ and $V_3$. More specifically, the overall bias arrangement shown in particularly suitable with an electrophotographic copying apparatus of the type which is capable of making two copies from a single latent image. To this end, readily providable means generally indicated at 32 are used for operatively interconnecting switch 30 with the controlled rotation of drum 14 such that the switch is in its solid line position during formation of the first copy from a given image and its dotted line position during formation of a second copy. Thus, during formation of the first copy, the voltage source $V_2$ is used to bias the front face of sheet 26 and during formation of the second copy the voltage source $V_3$ is used for the same purpose. In this particular embodiment, the voltage levels provided by the sources $V_1$, $V_2$ and $V_3$ are such that a greater combined voltage level is provided at the paper during formation of the first copy than formation of the second copy sufficient to ensure that approximately the same amount of toner will be transferred during formation of each copy, taking into account that the electrical potentials making up the latent image tend to decay with time and that untransferred toner from the first image remains on the developing drums surface, as discussed previously. The exact values for $V_1$, $V_2$ and $V_3$ will depend upon these latter factors as well as the particular transfer roll and paper used and can be readily provided by means of trial and error in view of the teachings herein.

Overall, apparatus 10 has been shown including a transfer station displaying two specific features of the present invention. In accordance with one feature the transfer roll and the continuous sheet are biased, thereby providing a double biased system. In accordance with the second feature, the biasing level is changed for two successive copies from a given latent image thereby providing a changing biased system. It is to be understood that the double biased system can be provided without the changing biased system and vice versa. In the former case, a single voltage supply can be used to charge the front face of sheet 26 or, as stated, a single voltage supply and suitable voltage dividing circuitry can be utilized to bias both the front face of the sheet and the transfer roll. On the other hand, when using the changing biased system, the sheet itself can be biased using two different voltage, as shown, without biasing the transfer roll or the transfer roll itself could be biased at two different levels without biasing the paper itself. Of course, both features can be combined as shown in FIG. 1.

What is claimed is:

1. In an electrophotographic copying apparatus in which electrically charged toner of one polarity is transferred from an oppositely electrically charged surface of its photoconductive drum to the front side of a blank sheet for transforming the latter into an intended copy as the back side of the sheet engages the outer surface of a transfer roll positioned adjacent said drum, the improvement comprising means for simultaneously electrically biasing the front side of said blank sheet, before the latter receives said toner, and the outer surface of said transfer roll such that each carries the same charge as said drum surface and such that the combined voltage level of both is greater than the voltage level of the charged surface of said drum, whereby to cause toner to be transferred from said drum surface to said blank sheet; said biasing means including means for changing said combined voltage level.

2. The improvement according to claim 1 wherein said means for changing said combined voltage level includes means for automatically providing said combined level at a given magnitude for each first copy which is made in each successive pair and at a lowering magnitude for each second copy in each pair.

3. In an electrophotographic copying apparatus in which electrically charged toner of one polarity is transferred from an oppositely charged electrostatic image on the outer surface of its photoconductive drum to the front side of a blank sheet for transforming the latter into an intended copy as the back side of the sheet engages the outer surface of a transfer roll positioned adjacent said drum, said outer surface of said drum being capable of retaining said electrostatic latent image for two cycles of the drum whereby to be able to provide two copies from a single latent image, the improvement comprising means for providing an electrical bias at said paper, as the latter receives said transferred toner, of the same polarity as said drum surface and at a voltage level which is greater than the voltage level of said latent image, whereby to cause toner to be transferred from said drum surface to said blank sheet, said biasing means including means for automatically providing its voltage level at a first magnitude for each first copy which is made from a given image and at a second lesser magnitude for each second copy which is made from the same given image.

4. The improvement according to claim 3 wherein the front side of said blank sheet and the outer surface of said transfer roll are both electrically biased by said biasing means to provide a combined voltage level.

5. In the operation of an electrophotographic copying apparatus in which electrically charged toner of one polarity is transferred from an oppositely charged electrostatic image on the outer surface of its photoconductive drum to the front side of a blank sheet for transforming the latter into an intended copy as the back side of the sheet engages the outer surface of a transfer roll positioned adjacent said drum, a method of aiding in the transfer of said toner from said drum to said blank sheet, said method comprising the step of simultaneously electrically biasing the front side of said blank sheet, before the latter receives said toner and the outer surface of said transfer roll such that each carries the same charge as said drum surface and such that the combined voltage level of both is greater than the voltage level of the charged surface of said drum, whereby to cause toner to be transferred from said drum surface to said blank sheet, the front said of said blank sheet and the outer surface of said transfer roll being biased to approximately equal voltage levels.

6. In the operation of an electrophotographic copying apparatus in which electrically charged toner of one polarity is transferred from an oppositely charged electrostatic image on the outer surface of its photoconductive drum to the front side of a blank sheet for transforming the latter into an intended copy as the back side of the sheet engages the outer surface of a transfer roll position adjacent said drum, said outer surface of said drum being capable of retaining said electrostatic latent image for two cycles of the drum whereby to be able to provide two copies from a single latent image, a method of aiding in the transfer of said toner from said drum to said blank sheet in the case where the apparatus is used to make two copies from one latent image, said method comprising the step of providing an electrical bias at said paper, as the latter receives said transfer toner, of the same polarity of said drum surface and that a voltage level which is greater than the voltage level of said latent image, whereby to cause toner to be transferred from the drum surface to said blank sheet, said biasing step including the step of automatically providing its voltage level at a first magnitude for each first copy which is made from a given image and that a second lesser magnitude for each second copy which is made from the same given image.

7. In an electrophotographic copying apparatus in which electrically charged toner of one polarity is transferred from an oppositely electrically charged surface of its photoconductive drum to the front side of a blank sheet for transforming the latter into an intended copy as the back side of the sheet engages the outer surface of a transfer roll positioned adjacent said drum, the improvement comprising means for simultaneously electrically biasing the front side of said blank sheet, before the latter receives said toner, and the outer surface of said transfer roll such that each carries the same charge as said drum surface and such that the combined voltage level of both is greater than the voltage level of the charged surface of said drum, whereby to cause toner to be transferred from said drum surface to said blank sheet, the front side of said blank sheet and the outer surface of said transfer roll being biased to approximately equal voltage levels.

* * * * *